US005640739A

United States Patent [19]

Campbell

[11] Patent Number: 5,640,739

[45] Date of Patent: Jun. 24, 1997

[54] COMBINED VACUUM NOZZLE AND CLEANING FLUID SPRAYER

[75] Inventor: Joanne Marie Campbell, Klamath Falls, Oreg.

[73] Assignee: Production Metal Forming, Inc., Klamath Falls, Oreg.

[21] Appl. No.: 472,424

[22] Filed: Jun. 7, 1995

[51] Int. Cl.[6] ..... A47L 13/22

[52] U.S. Cl. ..... 15/321; 15/322

[58] Field of Search ..... 15/321, 322; 248/61, 248/67.7, 75, 82

[56] References Cited

U.S. PATENT DOCUMENTS

| | | |
|---|---|---|
| 2,722,397 | 11/1955 | Bruce et al. . |
| 3,288,430 | 11/1966 | Priese . |
| 3,474,829 | 10/1969 | Scheineman . |
| 4,009,728 | 3/1977 | Parise . |
| 4,998,317 | 3/1991 | Passien . |

FOREIGN PATENT DOCUMENTS

| | | |
|---|---|---|
| 2704308 | 8/1978 | Germany . |

*Primary Examiner*—David Scherbel
*Assistant Examiner*—Terrence Till
*Attorney, Agent, or Firm*—Dority & Manning, P.A.

[57] ABSTRACT

A combined nozzle and cleaning fluid dispenser for a fluid vacuum cleaning system is provided. The combined nozzle and cleaning fluid dispenser is for simultaneously applying a cleaning fluid and a vacuum force to a surface or object. The combined nozzle and cleaning fluid dispenser includes a hollow, rigid wand attached to a suction chamber having an open, free end. Attached to the wand is a cleaning fluid sprayer which includes a valve, a lever arm and a spray head for dispensing a cleaning fluid. In accordance with the present invention, the spray head is positioned within the suction chamber. In this arrangement, the cleaning fluid is substantially prevented from being dispensed from the suction chamber unless the suction chamber is in contact with a surface to be cleaned. The combined nozzle and cleaning fluid dispenser of the present invention not only prevents against pooling or puddling of the cleaning fluid but also allows for controlled and precise dispensation of the fluid.

18 Claims, 2 Drawing Sheets

COMBINED VACUUM NOZZLE AND CLEANING FLUID SPRAYER

BACKGROUND OF THE INVENTION

The present invention relates generally to a fluid vacuum cleaning system of the type particularly adapted for cleaning the surfaces of upholstery, carpet and the like. In particular, the present invention is directed to a combined vacuum nozzle and cleaning fluid sprayer for a fluid vacuum cleaning system.

Fluid vacuum cleaning systems of the type discussed herein are mainly used for cleaning carpeting, draperies, and furniture upholstery. Typical systems include a vacuum cleaner, a vacuum hose pipe, a cleaning fluid sprayer and a nozzle. During operation, the cleaning fluid sprayer sprays a cleaning fluid on a surface being cleaned while the nozzle applies a vacuum. The cleaning detergent dissolves and dislodges greases, stains, dirt and other particles while the vacuum removes them from the surface.

More specifically, fluid vacuum cleaning systems typically include a vacuum hose pipe, which extends from a vacuum cleaner where a vacuum is created. The vacuum hose pipe is attached to a tubular wand which, in turn, leads into the nozzle. The nozzle includes a hollow suction head consisting of a pair of spaced apart plates, which can be trapezoidal in shape. The plates are enclosed at the top and at the sides leaving an open end for the application of a vacuum force to a surface. Typically, the plates are spaced relatively close together and flare out at the open end forming a long, narrow slit. Consequently, the suction force of the vacuum is concentrated along this narrow slit.

Currently, cleaning fluid dispensers are mounted to the above described tubular wand behind the hollow suction head. During cleaning, the fluid dispenser dispenses a fluid behind the vacuum nozzle onto the surface being cleaned. In a back and forth motion, the nozzle is then used to vacuum up the fluid. During this process, the bottom edges of the plate surrounding the narrow slit of the nozzle form a seal between the nozzle and the surface being cleaned. Formation of a seal between the nozzle and the surface causes a reduction in the suction force, but still allows the nozzle to remove moisture and dirt from the surface. However, once a seal is formed, the nozzle is substantially prevented from removing any excess liquid on the surface. Instead of picking up the excess liquid, the nozzle performs more like a squeegee in pushing or spreading the liquid elsewhere.

In order to vacuum up any excess fluid, the seal formed between the nozzle and the surface must be broken by physically lifting the nozzle and placing it in the pool or puddle of excess liquid. However, when the nozzle head is lifted, the material being cleaned tends to get caught in the open end of the nozzle due to a combination of the lifting movement and the suction force. Some materials, especially napped fabrics, can become creased or marked when this occurs. Also, periodic lifting of the nozzle off the surface leads to sporadic and nonuniform cleaning.

Since it is very difficult to control the dispensation of the cleaning fluid and/or to avoid puddling or pooling of the fluid, attempts have been made to modify the vacuum nozzle in order to remove excess liquid without having to lift the nozzle off the surface. One such attempt has included putting notches at the edges of the plates forming the open end of the nozzle. In this arrangement, the nozzle does not form a seal with the surface being cleaned allowing fluid to be collected up through the notches. Unfortunately, the suction force of the vacuum cleaner can also pull the material into the notches possibly causing marks or creases.

Therefore, a need exists for a nozzle for a fluid vacuum cleaning system that prevents the build up of excess cleaning fluid on the surface being cleaned. In particular, such a nozzle would be most advantageous when cleaning upholstery and the like in order to prevent soaking the article with a cleaning detergent.

Besides problems associated with excess pooling or puddling, having the fluid dispenser mounted to the back of the vacuum nozzle also makes it difficult to precisely control the area to which the cleaning fluid is sprayed. For instance, when using the nozzle and cleaning fluid dispenser combination to clean specific items such as upholstery or draperies, frequently the cleaning fluid is dispensed not only on the item being cleaned but also on adjacent surfaces and structures. As such, a need also exists for a vacuum nozzle and cleaning fluid sprayer that only dispenses fluid upon the particular item being cleaned.

SUMMARY OF THE INVENTION

The present invention recognizes and addresses various of the foregoing drawbacks, and others concerning nozzles and cleaning fluid dispensers for fluid vacuum cleaning systems. Thus, broadly speaking, one main object of this invention is to provide an improved nozzle for a fluid vacuum cleaner.

It is another principal object of the present invention to provide a combined nozzle and cleaning fluid sprayer for a fluid vacuum cleaning system which prevents against the creation of pools or puddles of excess cleaning fluid when in use.

It is another object of the present invention to provide a cleaning fluid sprayer mounted within a vacuum nozzle.

It is a further object of the present invention to provide a combined fluid sprayer and nozzle for a fluid vacuum cleaning system that uniformly cleans surfaces of carpet, upholstery and the like without soaking them with cleaning fluid.

Another object of the present invention is to provide a combined fluid sprayer and nozzle for a fluid vacuum cleaning system that only dispenses a cleaning fluid on the object to be cleaned.

Additional objects and advantages of the invention are set forth in or will be apparent to those of ordinary skill in the art from the detailed description which follows. Also, it should be further appreciated that modifications and variations to the specifically illustrated and discussed features or materials hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like. Still further, it is to be understood that different embodiments, as well as different preferred embodiments, of this invention may include various combinations or configurations of presently disclosed features or elements or their equivalents (including combinations or configurations thereof not expressly shown in the figures or stated in the detailed description). One such exemplary embodiment of the present invention relates to a combined nozzle and cleaning fluid dispenser for a fluid vacuum cleaning system.

The combined nozzle and cleaning fluid dispenser includes a hollow wand having a first end adapted for attachment to a vacuum hose pipe of a vacuum cleaner. A second end of the wand is in communication with a suction chamber. The suction chamber includes a pair of opposing plates spaced apart from each at predetermined distance and being enclosed at adjacent sides. The suction chamber further includes an open end for contact with a surface to be cleaned.

The combined nozzle and cleaning fluid dispenser further includes a spray head located inside the suction chamber. The spray head is in operative association with a cleaning fluid dispenser for controlled dispensation of a cleaning fluid out through the open end of the chamber. In one embodiment, the spray head is in fluid communication with a valve. The valve is attached to a cleaning fluid dispensing line and is normally biased to prevent the flow of cleaning fluid there through. The valve is actuated by a lever arm for dispensing a cleaning fluid out through said spray head.

The spray head can extend from the valve into the suction chamber through an aperture defined by one of the opposing plates. Preferably, the spray head is positioned within the suction chamber a predetermined distance from the open end such that, when a vacuum force is applied to the wand, the spray head is substantially prevented from emitting a cleaning fluid from the suction chamber unless the suction chamber has formed a seal with a surface.

Another exemplary embodiment of the present invention is directed to a combined nozzle and fluid dispenser for a fluid vacuum cleaning system which includes a nozzle having a hollow wand angularly attached to a suction chamber. The suction chamber includes a pair of opposing plates spaced apart from each other a predetermined distance. The opposing plates are enclosed at adjacent sides by a pair of opposing side panels. The edges of the plates define an open end for applying a vacuum force created by a vacuum cleaner to a surface to be cleaned.

The combined nozzle and cleaning fluid sprayer further includes a cleaning fluid dispenser connected to said nozzle. The cleaning fluid dispenser includes a valve adapted for attachment to a cleaning fluid dispensing line. The valve is normally biased to prevent the flow of a cleaning fluid therethrough and is actuated by a lever arm. The cleaning fluid dispenser also includes a spray head in communication with the valve. The spray head is located within the nozzle and is positioned a predetermined distance from the open end such that, when a vacuum force is applied to the nozzle, a cleaning fluid dispensed from the spray head is substantially prevented from being released from the suction chamber unless the suction chamber has been applied to a surface.

The combined nozzle and cleaning fluid dispenser can further include clamping means for attaching the cleaning fluid dispenser to the nozzle. The clamping means can include a pair of clampable brackets.

The pair of opposing plates of the suction chamber can also have curled edges defining the open end. The curled edges are for facilitating the application of the suction chamber to a surface.

The present invention is also directed to a fluid vacuum cleaning system for cleaning the surfaces of upholstery, carpets, draperies and the like with a cleaning fluid. The fluid vacuum cleaning system includes a vacuum and fluid dispensing apparatus having means for creating and maintaining a vacuum in a vacuum chamber and means for dispensing a cleaning fluid. A vacuum hose pipe is connected to the vacuum chamber at one end while a cleaning fluid tube is connected to the fluid dispensing means.

The fluid vacuum cleaning system further includes a combined nozzle and cleaning fluid sprayer connected both to the vacuum hose pipe and to the cleaning tube. The combined nozzle and cleaning fluid sprayer includes a nozzle having an open end for applying a vacuum force created by the vacuum and fluid dispensing apparatus to a surface. A cleaning fluid dispenser is in communication with the cleaning fluid tube and has a spray head positioned within the nozzle for control dispensation of the cleaning fluid out through said open end.

The nozzle of the fluid vacuum cleaning system can include a hollow wand angularly attached to a suction chamber. In one embodiment, the spray head can be positioned within the suction chamber a predetermined distance from the open end of the nozzle.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which.

Figure 1:
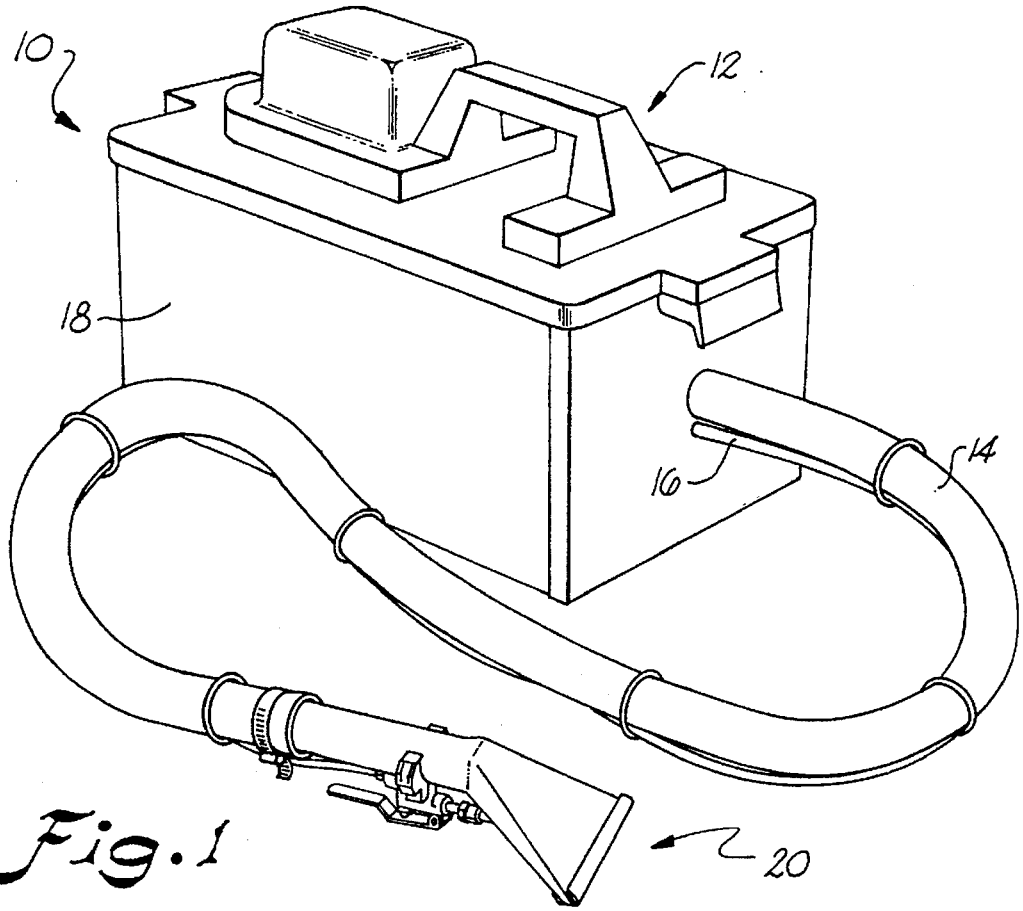
FIG. 1 is a perspective view of a fluid vacuum cleaning system made in accordance with the present invention.

Repeat use of reference characters throughout the present specification and appended drawings is intended to represent same or analogous features or elements of the invention.

DETAILED DESCRIPTION OF THE PREFERRED EMBODIMENTS

Reference will now be made in detail to the presently preferred embodiments of the invention, a complete example of which is fully illustrated in the accompanying drawings. The drawings and accompanying discussion are provided by way of an explanation of the invention, not limitation of the invention. In fact, it will be apparent to those skilled in the art that various modifications and variations can be made in the present invention. For instance, features illustrated or described as part of one embodiment can be used on another embodiment to yield a still further embodiment. Additionally, certain features may be interchanged with similar devices or features not mentioned yet which perform the same or similar function. For example, the hand held nozzle illustrated might be incorporated into a stand up embodiment with accompanying wheels. Thus, it is intended that the present invention cover such modifications and variations as come within the scope of the appended claims or their equivalents.

As shown in FIG. 1, an exemplary fluid vacuum cleaning system generally 10 for use in cleaning carpeting, fabric, furniture upholstery or the like is illustrated. Fluid vacuum cleaning system 10 includes a vacuum and fluid dispensing apparatus generally 12 having a vacuum hose pipe 14 and a fluid dispensing line 16 connected thereto. Vacuum hose pipe 14 and fluid dispensing line 16 terminate at a combined nozzle and cleaning fluid dispenser generally 20. Apparatus 12 dispenses cleaning fluid out line 16 while maintaining a vacuum in a vacuum chamber 18. The vacuum creates a suction force in vacuum hose pipe 14. Combined nozzle and cleaning fluid dispenser 20 applies the cleaning fluid and suction force to a surface or object to be cleaned.

Figure 2:
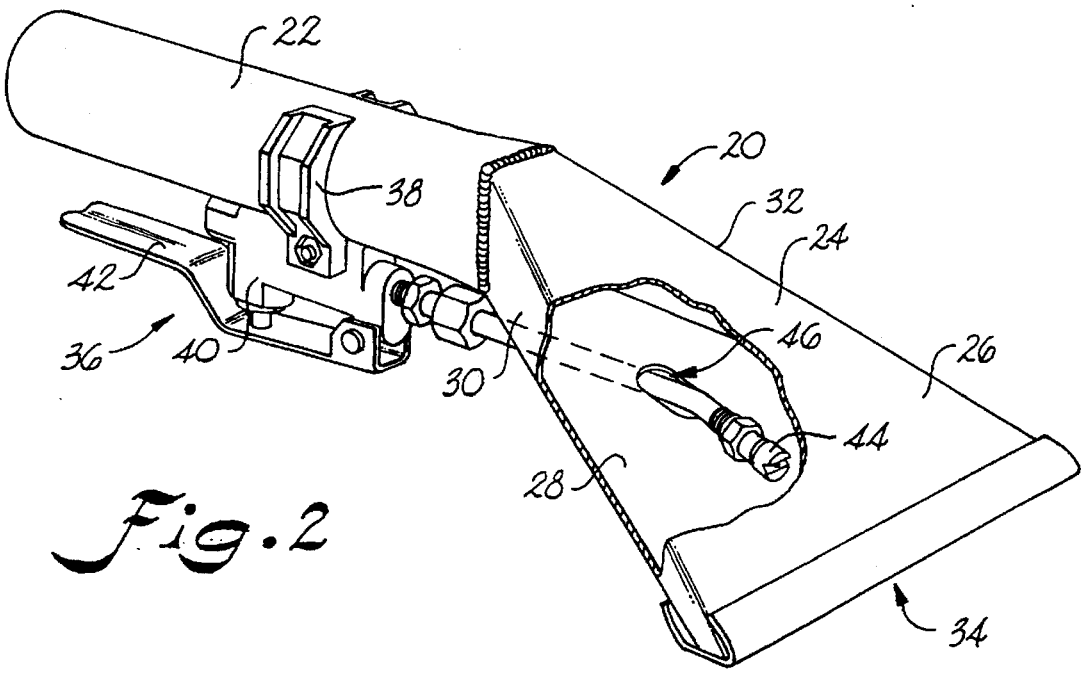
FIG. 2 is a perspective view with cutaway portions of one preferred embodiment of the present invention.
Figure 3:
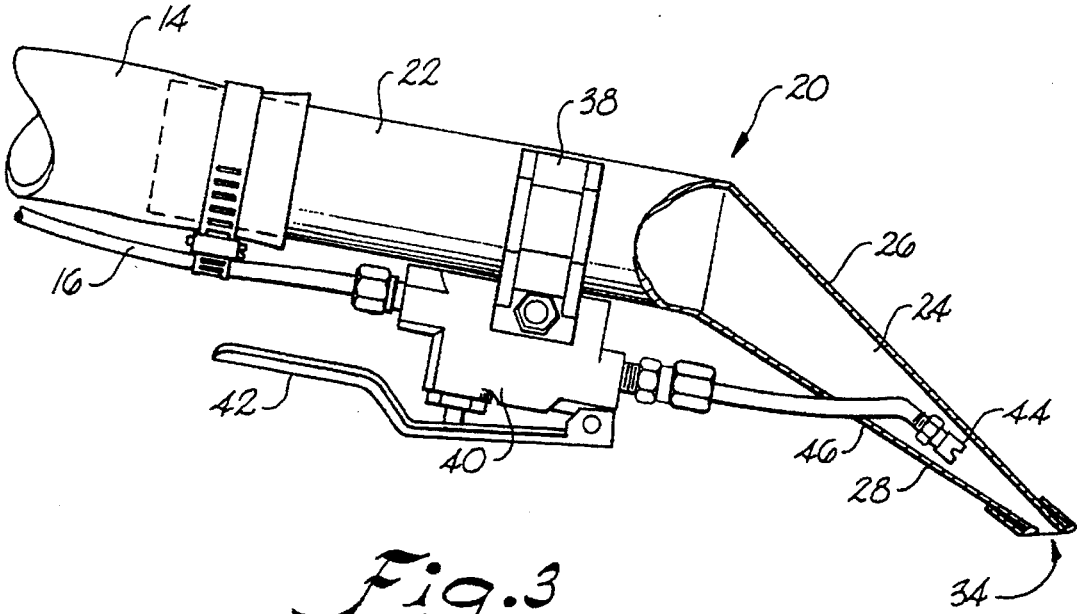
FIG. 3 is a side view with cutaway portions of the embodiment of the present invention illustrated in FIG. 2.

Referring to FIGS. 2–5, one preferred embodiment of combined nozzle and cleaning fluid dispenser 20 made in accordance with the present invention is illustrated. As shown in FIGS. 2 and 3, combined nozzle and cleaning fluid dispenser 20 includes a rigid, hollow wand 22 attached to or integral with a suction chamber 24. As shown in FIG. 3, a passageway leads from wand 22 into suction chamber 24.

As illustrated, wand 22 can be welded to suction chamber 24. However, the wand and chamber can be attached by any other suitable means. As also shown in the Figures, suction chamber 24 is connected to wand 22 at an angle. This angle of attachment can be varied depending upon the particular cleaning application or the contours of the surface to be cleaned.

Suction chamber 24 includes a front plate 26 spaced in close proximity to a rear plate 28. Front plate 26 and rear plate 28 can be trapezoidal in shape and can extend from wand 22 at different angles as illustrated in the Figures. Plates 26 and 28 are interconnected and partially enclosed by a pair of opposing side panels 30 and 32. Suction chamber 24 further includes an open end 34 in the shape of a narrow slit defined by the bottom edges of top plate 26, bottom plate 28 and side panels 30 and 32. In this embodiment, the edges of top plate 26 and bottom plate 28 have been bent or curled about open end 34. This arrangement not only eliminates sharp edges but also creates a smooth surface for facilitating the application of the nozzle.

When a vacuum is created in vacuum chamber 18, a suction force is created within vacuum hose pipe 14 and wand 22. This suction force becomes concentrated along open end 34 of suction chamber 24. When open end 34 is applied to a surface, dirt moisture and cleaning fluid is removed and collected in vacuum and fluid dispensing apparatus 12.

Combined nozzle and cleaning fluid dispenser 20 further includes a cleaning fluid sprayer generally 36 which, in this embodiment, is mounted to wand 22 by a pair of clampable brackets 38. Cleaning fluid sprayer 36 includes a valve 40 which is actuated by a lever arm 42. Specifically, valve 40 is adapted to be connected to fluid dispensing line 16 as shown in FIG. 3 and is normally biased to prevent the flow of a cleaning fluid therethrough. When lever arm 42 is displaced upwards, however, cleaning fluid is controllably dispensed out a spray head 44.

In accordance with the present invention, spray head 44 is positioned within suction chamber 24. In particular, spray head 44 extends from valve 40 into suction chamber 24 through an opening or aperture 46 defined by rear plate 28. In the past, a fluid dispenser was positioned behind the suction chamber where the fluid was dispensed. As described above, this arrangement could cause pooling or puddling problems and made it more difficult to precisely control where the fluid was sprayed. For instance, when cleaning draperies or upholstery, it was not uncommon for a cleaning fluid to be sprayed on other furniture, on the walls, on the floor or on other objects that were not being cleaned.

By positioning spray head 44 within suction chamber 24, the problems and deficiencies of the prior art are alleviated. The present invention not only prevents against excessively soaking the item being cleaned but also makes it much easier to control the amount of fluid being applied to a surface and the particular area to which the fluid is dispensed.

Figure 4:
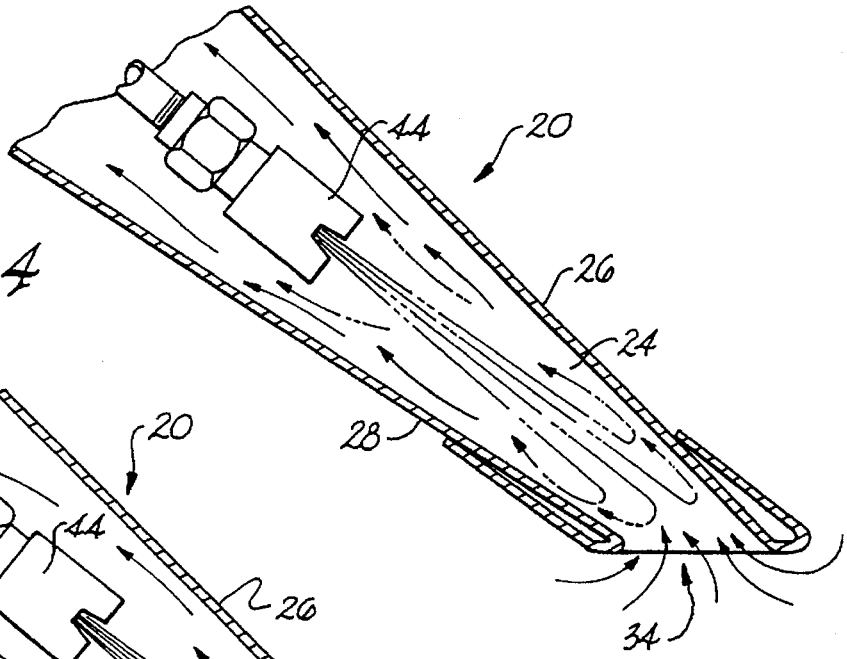
FIG. 4 is a side view with cutaway portions of the embodiment of the present invention as shown in FIG. 2.

For instance, referring to FIG. 4, a partial view of combined nozzle and cleaning fluid dispenser 20 is illustrated in operation. Spray head 44 is shown dispensing a cleaning fluid while air is shown flowing through suction chamber 24 caused by a vacuum being generated upstream by a vacuum and fluid dispensing apparatus. In particular, combined nozzle and cleaning fluid dispenser 20 is shown not in contact with a surface. Consequently, the air flow through suction chamber 24 and the suction force are at a maximum.

In this situation, the cleaning fluid is substantially prevented from being released from the suction chamber and, instead, is forced back through suction chamber 24 and wand 22. Ultimately, the cleaning fluid is collected by the vacuum and fluid dispensing apparatus.

In this arrangement, the cleaning fluid is substantially prevented from being released from suction chamber 24 onto objects or surfaces that are not being cleaned. As such, in a preferred embodiment, spray head 44 is positioned a preselected distance from opening 34 so that cleaning fluid is not released from the suction chamber when combined nozzle and cleaning fluid dispenser 20 is not in contact with a surface or object.

The precise position of spray head 44 within suction chamber 24 will depend upon various factors. For instance, the location of spray head 44 will depend upon the horse power of the vacuum motor, the viscosity of the cleaning fluid, the force the cleaning fluid is dispensed from spray head 44, and the dimensions of opening 34 and of suction chamber 24. Consequently, it may even be necessary in some applications to locate spray head 44 in wand 22 instead of in suction chamber 24.

Figure 5:
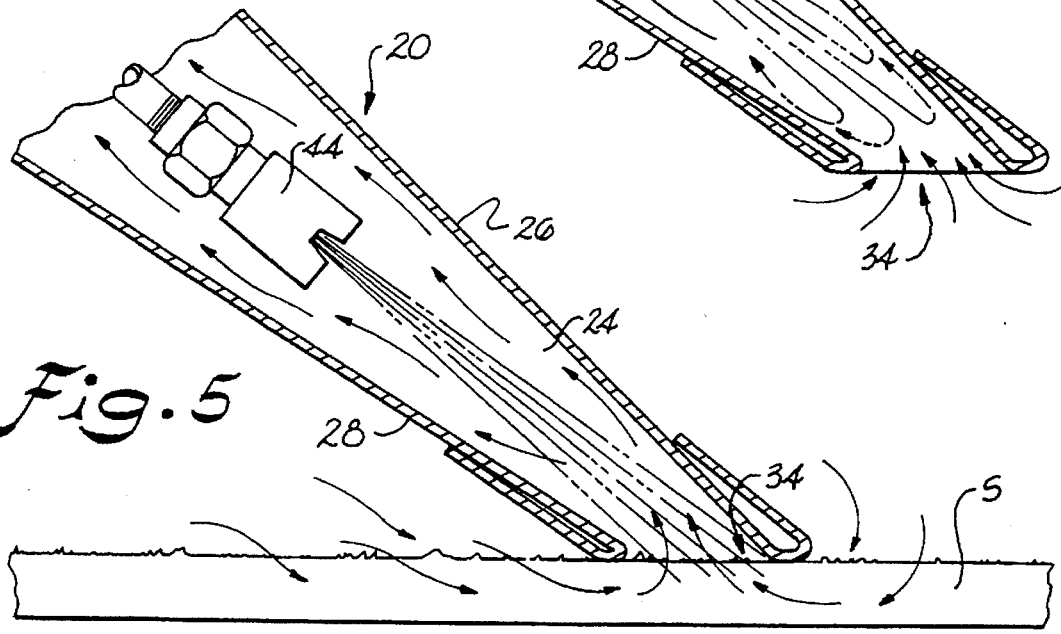
FIG. 5 is another side view with cutaway portions of the embodiment of the present invention as shown in FIG. 2.

Another view of combined nozzle and cleaning fluid dispenser 20 in operation is illustrated in FIG. 5. In this Figure, suction chamber 24 is shown applied to a surface S that is being cleaned. In this situation, suction chamber 24 forms a seal with surface S causing a decrease in the suction force created by the vacuum cleaner due to decreased air flow through the chamber. Because the suction force is decreased, spray head 44 is capable of applying a cleaning fluid to surface S. Once the cleaning fluid is applied to surface S, it can then be picked up by the vacuum cleaner.

In other words, in one embodiment of the combined nozzle and cleaning fluid dispenser of the present invention, cleaning fluid is only released from the suction chamber when the suction chamber has formed a seal with the surface or object being cleaned. When a seal forms between the suction chamber and the surface or object, the suction force of the vacuum cleaner is decreased to a point where the suction force cannot counteract the force at which the cleaning fluid is emitted from the spray head. The suction force, however, is still capable of drawing in cleaning fluid that has already been applied.

In this manner, cleaning fluid is only applied to the surface or object being cleaned. The dispensation of the cleaning fluid is further limited by the confines of the suction chamber walls. Consequently, since the spray head is located in the suction chamber, cleaning fluid is only being applied at any given time to an area defined by the boundaries of opening 34. The combined nozzle and cleaning fluid dispenser of the present invention also substantially reduces the risk of excessively soaking the surface or object being cleaned.

In general, combined nozzle and cleaning fluid dispenser 20 can be made from a variety of different materials including stainless steel, plastics, ceramics, and the like. Preferably, nozzle and cleaning fluid dispenser 20 is made from a material that will not corrode when contacted with a cleaning fluid. The particular dimensions of combined nozzle and cleaning fluid dispenser 20 may also vary depending upon the particular application and the horse power of the vacuum motor. For instance, small spaces to be cleaned or fluid vacuum cleaning systems with smaller vacuum motors may required a smaller nozzle. Further, combined nozzle and cleaning fluid dispenser 20 can be a hand-held embodiment as shown in the Figures or can be incorporated into an upright model. If desired, wheels may also be added to the nozzle in order to assist in movement.

While particular embodiments of the invention have been described and shown, it will be understood by those of ordinary skill in the art that the present invention is not limited thereto since many modifications may be made, without departing from the spirit and scope of the present invention, which is more particularly set forth in the appended claims. In addition, it should be understood that aspects of the various embodiments may be interchanged both in whole or in part. Furthermore those of ordinary skill in the art will appreciate that the foregoing description is by way of example only, and is not intended to limit the invention so further described in such appended claims.

What is claimed:

1. A combined nozzle and cleaning fluid dispenser for use in a fluid vacuum cleaning system, said combined nozzle and cleaning fluid dispenser comprising:

a hollow wand having a first end and a second end, said first end being adapted for attachment to a vacuum hose pipe of a vacuum cleaner;

a suction chamber in communication with said second end of said wand, said suction chamber comprising a pair of opposing plates spaced apart from each other a predetermined distance, said plates being enclosed at adjacent sides, said suction chamber further including an open end for contact with a surface to be cleaned; and a spray head located inside said suction chamber, said spray head being in operative association with a cleaning fluid dispenser for controlled dispensation of a cleaning fluid out through said open end of said chamber, said spray head being positioned relative to said suction chamber such that when a cleaning fluid is dispensed from said suction chamber said cleaning fluid is emitted from said spray head directly out through said open end onto a surface to be cleaned, and wherein said spray head is positioned within said suction chamber a predetermined distance from said open end such that, when a vacuum force is applied to said wand, said cleaning fluid dispensed from said spray head is substantially prevented from being emitted from said suction chamber unless said suction chamber is applied to a surface.

2. A combined nozzle and cleaning fluid dispenser as defined in claim 1, further comprising a valve in fluid communication with said spray head, said valve being adapted for attachment to a fluid dispensing line and normally being biased to prevent the flow of cleaning fluid therethrough, said valve being actuated by a lever arm for dispensing a cleaning fluid out said spray head.

3. A combined nozzle and cleaning fluid dispenser as defined in claim 2, further comprising a pair of clampable brackets for mounting said valve to said hollow wand.

4. A combined nozzle and cleaning fluid dispenser as defined in claim 2, wherein said spray head extends from said valve into said suction chamber through an aperture defined by one of said opposing plates.

5. A combined nozzle and cleaning fluid dispenser as defined in claim 1, wherein said pair of opposing plates have curled edges defining the open end of said suction chamber for facilitating the application of said suction chamber to a surface.

6. A combined nozzle and cleaning fluid dispenser as defined in claim 1, wherein said suction chamber extends from said wand at an angle.

7. A combined nozzle and cleaning fluid dispenser as defined in claim 1, wherein said pair of opposing plates are enclosed at adjacent sides by a pair of opposing side panels.

8. A combined nozzle and cleaning fluid dispenser for a fluid vacuum cleaning system, said combined nozzle and cleaning fluid dispenser comprising:

a nozzle comprising a hollow wand angularly attached to a suction chamber, said wand being adapted for attachment to a vacuum hose pipe of a vacuum cleaner, said suction chamber including a pair of opposing plates spaced apart from each other a predetermined distance, said plates being enclosed at adjacent sides by a pair of opposing side panels, said suction chamber further including an open end for applying a vacuum force created by a vacuum cleaner to a surface to be cleaned; and a cleaning fluid dispenser connected to said nozzle, said cleaning fluid dispenser comprising a valve adapted for attachment to a fluid dispensing line, said valve normally being biased to prevent the flow of cleaning fluid therethrough and being actuated by a lever arm, said cleaning fluid dispenser further including a spray head in communication with said valve, said spray head being located within said nozzle such that when a cleaning fluid is dispensed from said suction chamber said cleaning fluid is emitted from said spray head directly out through said open end onto a surface to be cleaned, said spray head being positioned a predetermined distance from said open end such that, when a vacuum force is applied to said nozzle, a cleaning fluid dispensed from said spray head is substantially prevented from being released from said suction chamber unless said suction chamber is applied to a surface.

9. A combined nozzle and cleaning fluid dispenser as defined in claim 8, wherein said spray head is positioned within said suction chamber.

10. A combined nozzle and cleaning fluid dispenser as defined in claim 8, wherein each of said pair of opposing plates extend from said wand at different angles.

11. A combined nozzle and cleaning fluid dispenser as defined in claim 8, wherein said pair of opposing plates have curled edges defining said open end of said suction chamber, said curled edges for facilitating the application of said suction chamber to a surface.

12. A combined nozzle and cleaning fluid dispenser as defined in claim 8, wherein said spray head is connected to said valve by a conduit and wherein said conduit extends from said valve into said nozzle through an aperture defined by said nozzle.

13. A combined nozzle and cleaning fluid dispenser as defined in claim 8, further comprising clamping means for attaching said cleaning fluid dispenser to said nozzle.

14. A fluid vacuum cleaning system for cleaning the surfaces of upholstery, carpets, draperies and the like with a cleaning fluid, said fluid vacuum cleaning system comprising:

a vacuum and fluid dispensing apparatus including suction means for creating and maintaining a vacuum in a vacuum chamber and fluid dispensing means for dispensing a cleaning fluid;

a vacuum hose pipe having a first end and a second end, said first end being connected to said vacuum chamber;

a cleaning fluid tube having a first end and a second end, said first end being connected to said fluid dispensing means; and a combined nozzle and cleaning fluid sprayer connected to said second end of said vacuum hose pipe and to said second end of said cleaning fluid tube, said combined nozzle and cleaning fluid sprayer including a nozzle having an open end for applying a vacuum force created by said vacuum and fluid dispensing apparatus to a surface, said combined nozzle and cleaning fluid sprayer also including a cleaning fluid dispenser in communication with said cleaning fluid tube, said cleaning fluid dispenser having a spray head located within said nozzle, said spray head being positioned relative to said nozzle such that when a cleaning fluid is dispensed from said nozzle said cleaning fluid is emitted from said spray head directly out through said open end onto a surface to be cleaned, and wherein said spray head is positioned within said nozzle a predetermined distance from said open end such that, when a vacuum force is applied to said nozzle, said cleaning fluid dispensed from said spray head is substantially prevented from being emitted out through said open end of said nozzle unless said open end is applied to a surface.

15. A fluid vacuum cleaning system as defined in claim 14, wherein said nozzle comprises a hollow wand angularly attached to a suction chamber, said suction chamber defining said open end of said nozzle for contact with a surface to be cleaned.

16. A fluid vacuum cleaning system as defined in claim 15, wherein said spray head is positioned within said suction chamber.

17. A fluid vacuum cleaning system as defined in claim 14, wherein said cleaning fluid dispenser includes a valve in fluid communication with said spray head, said valve being connected to said cleaning fluid tube and being normally biased to prevent the flow of cleaning fluid therethrough, said valve being actuated by a lever arm for dispensing a cleaning fluid out said spray head.

18. A fluid vacuum cleaning system as defined in claim 17, further comprising a pair of clampable brackets for attaching said valve to said nozzle.

* * * * *

UNITED STATES PATENT AND TRADEMARK OFFICE

CERTIFICATE OF CORRECTION

PATENT NO. : 5,640,739
DATED : June 24, 1997
INVENTOR(S) : Campbell

It is certified that error appears in the above-identified patent and that said Letters Patent is hereby corrected as shown below:

Title page,
Item [56], References Cited, U.S. PATENT DOCUMENTS, please add the following:

| | | |
|---|---|---|
| -- 2,270,579 | 1/42 | Chamberlin |
| 2,504,360 | 4/50 | Van Auken |
| 3,958,298 | 5/76 | Cannan |
| 4,073,030 | 2/78 | Albishausen |
| 4,083,077 | 4/78 | Knight, et al. |
| 4,649,594 | 3/87 | Grave |
| 4,872,920 | 10/89 | Flynn, et al. |
| 4,879,784 | 11/89 | Shero |
| 4,976,005 | 12/90 | Graye |
| 5,113,547 | 5/92 | Mayhew |
| 5,157,805 | 10/92 | Pinter -- |

Signed and Sealed this

Fifth Day of July, 2005

JON W. DUDAS
*Director of the United States Patent and Trademark Office*